United States Patent [19]

Simonetti

[11] Patent Number: 5,027,542

[45] Date of Patent: Jul. 2, 1991

[54] HANDLE FOR A FOREARM STOCK OF A PUMP ACTION GUN

[76] Inventor: Michael P. Simonetti, 3182 Weathervane, Troy, Mich. 48084

[21] Appl. No.: 535,764

[22] Filed: Jun. 11, 1990

[51] Int. Cl.[5] ..... F41C 7/02; F41C 23/16

[52] U.S. Cl. ..... 42/72

[58] Field of Search ..... 42/71.01, 72, 90

[56] References Cited

U.S. PATENT DOCUMENTS

| | | | |
|---|---|---|---|
| D. 177,679 | 5/1956 | Ivy . | |
| D. 285,236 | 8/1986 | Brunton . | |
| D. 300,161 | 3/1989 | Baldus et al. . | |
| D. 302,454 | 7/1989 | Lee . | |
| 1,277,002 | 8/1918 | Van Name . | |
| 1,300,940 | 4/1919 | Erikson | 42/90 |
| 1,357,208 | 10/1920 | Payne . | |
| 1,475,761 | 11/1923 | Fisher . | |
| 2,303,510 | 12/1942 | Swebilius . | |
| 2,471,276 | 5/1949 | Manville . | |
| 2,515,180 | 7/1950 | Barker . | |
| 2,826,848 | 3/1958 | Davies | 42/72 |
| 3,164,920 | 1/1965 | Haas, Jr. et al. . | |
| 3,736,839 | 6/1973 | Childers . | |
| 3,939,589 | 2/1976 | Tellie | 42/71.01 |
| 4,502,238 | 3/1985 | Farrar et al. . | |
| 4,837,961 | 6/1989 | Keenan | 42/72 |

*Primary Examiner*—Richard W. Wendtland

*Attorney, Agent, or Firm*—Harness, Dickey & Pierce

[57] ABSTRACT

The present invention is a pump action gun having a forearm stock incorporating a U-shaped handle. The U-shaped handle of the forearm stock is located at the lower portion of the forearm stock such that a gun operator's hand grasping the forearm stock will be positioned within the enclosure defined by the U-shaped handle to actuate the forearm stock.

11 Claims, 1 Drawing Sheet

HANDLE FOR A FOREARM STOCK OF A PUMP ACTION GUN

BACKGROUND OF THE INVENTION

1. Field of the Invention

The present invention relates generally to a pump action gun, and more specifically, to a handle for the forearm stock of a pump action shotgun.

2. Description of Related Art

It is known in the art to incorporate a pistol grip on a pump action gun for use as a weapon in riot situations. Generally, the forearm stock of the traditional pump action gun includes an elongated tubular sleeve having a number of vertical ribs by which a gun operator can grasp the forearm stock in a pump action and move the forearm stock toward and away the trigger to load and empty shells from the gun breech in a cocking motion. During a riot situation, as well as other situations, the tensefulness and apprehension the gun operator would feel could cause his or her hand to sweat. Therefore, during the cocking motion of the pump action gun, the gun operator's hand may slip on the forearm stock resulting in injury, loss of grip integrity of the forearm stock or loss of time for returning the forearm stock back to its original position to place the shotgun into a firing mode. During a riot situation, the loss of time may result in injury to the gun operator, and an increased chance of breakdown of the situation.

One notable change in the gripping method of a forearm stock is disclosed in U.S. Pat. No. 2,826,848 to Davies. In the Davies patent, a gripping member extends substantially perpendicular from the forearm stock of the pump action gun. However, the leveraging action caused by pulling or pushing of the perpendicular gripping member during the pump action will cause the gun operator to force the gun barrel away from the target after each repeated pumping action.

SUMMARY OF THE INVENTION

It is, therefore, one object of the present invention to provide a handle for a pump action gun.

It is another object of the present invention to provide a new and improved handle for a forearm stock of a pump action gun.

It is yet another object of the present invention to increase the comfort, confidence and safety of the gun operator and enable the gun operator to remain on target as the pump action is repeated.

It is still another object of the present invention to reduce slippage of an operator's hand during the pump action.

It is a further advantage of the present invention to deter jamming of the gun.

To achieve the foregoing objects, the present invention is a handle for a forearm stock of a pump action gun. The forearm stock is generally a tubular sleeve member, slidable along the magazine of the gun. Positioned at the lower surface of the forearm stock opposite the gun barrel, and at both ends, the handle comprises two vertical portions which are attached by a horizontal portion to form a space between the forearm stock and the horizontal portion. The space between the forearm stock and the horizontal portion provides a region in which a gun operator can place his or her hand to actuate the pumping action of the forearm stock.

One advantage of the present invention is that not only will the gun operator grasp the forearm stock in the traditional manner, but part of his or her hand may also rest against the vertical portion of the U-shaped handle which is closest to him or her. Such a configuration will virtually eliminate slippage of the gun operator's hand during the pumping action, and therefore, increase safety, comfort and confidence in the operation of the gun. Another advantage of the present invention is that the U-shaped handle allows the gun operator's hand to cover a much greater area of the forearm stock providing a stronger, smoother motion, thus reducing the possibility of jamming the weapon. Yet another advantage of the present invention is that the U-shaped handle will further offer protection for the gun operator's hand and will make it more difficult to remove the weapon from the gun operator's hand during hunting, law enforcement or riot situations. A further advantage of the present invention is that the U-shaped handle enables the gun operator to utilize the natural horizontal plane below the gun barrel during pumping action thus allowing the gun operator to remain on his target as the pump action is repeated.

Other objects, advantages and features of the present invention will be readily appreciated as the same becomes better understood from the following description and accompanying drawings.

DESCRIPTION OF THE PREFERRED EMBODIMENT(S)

Figure 1:
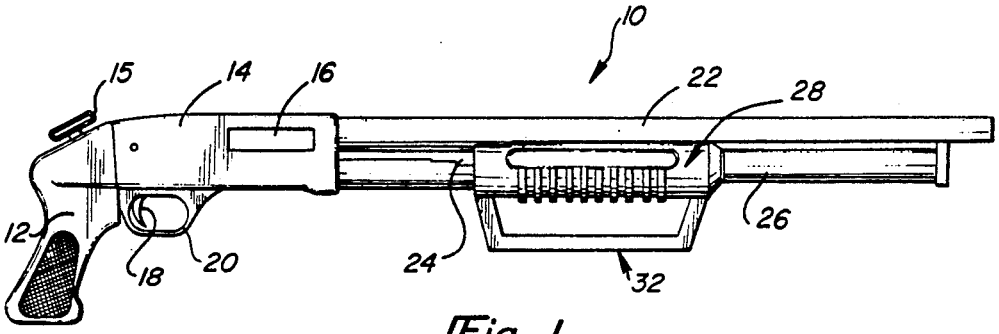
FIG. 1 is a side view of a pump action gun having a forearm stock and handle according to the present invention.

Referring to FIG. 1, a pump action type gun 10 such as a shotgun, rifle, paint ball type gun or the like is shown. The gun 10 also includes a grip 12 such as a pistol grip which is attached to one end of a gun breech 14. A sling swivel 15 may be provided to allow a strap (not shown) to pass therethrough. At least one fastener (not shown) is provided to allow the grip 12 to be removed from the gun breech 14 and replaced with a traditional gun stock, or other types of grips. It should be appreciated that any suitable means may be used to secure the grip 12 to the gun breech 14. The gun breech 14 generally includes an ejection port 16 and a trigger 18 surrounded by a trigger guard 20. Attached to the other end of the gun breech 14 opposite the grip 12 is a barrel 22 located atop and running parallel to a slide action linkage 24 and a magazine 26. It should be appreciated that up to this point in the description the gun 10 is conventional and known in the art.

The gun 10 also includes a forearm stock, generally indicated at 28, which is slidable along the magazine 26 below the barrel 22 by means of the slide action linkage 24. The forearm stock 28 includes a handle, generally indicated at 32, according to a preferred embodiment of the present invention. Generally, the grip 12 and the forearm stock 28 are made out of plastic or fiberglass or other suitable material and the barrel 22, magazine 26 and breech 14 are made out of steel or other suitable material well known to those skilled in the art.

Figure 2:
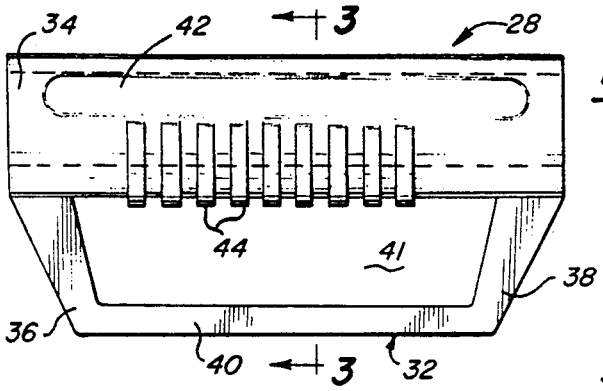
FIG. 2 is an enlarged side view of the handle and forearm stock of the pump action gun of FIG. 1.
Figure 3:
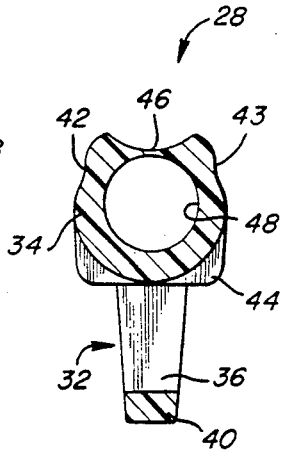
FIG. 3 is a sectional view taken along line 3—3 of FIG. 2.

Referring to FIGS. 2 and 3, different features of the forearm stock 28 and handle 32 according to a preferred embodiment of the present invention can be realized. The forearm stock 28 generally includes a substantially tubular sleeve 34. Located at the bottom region of the forearm stock 28 is the handle 32. The handle 32 is generally U-shaped and extends along substantially the entire length of sleeve 34 as shown. The handle 32 includes a generally vertical portion 36 located at the end of sleeve 34 closest to the gun breech 14 of the gun 10 and a generally vertical portion 38 located at the opposite end of sleeve 34. The vertical portions 36 and 38 extend away from the forearm stock 28 opposite the barrel 22. The handle 32 also includes a horizontal portion 40 joining the vertical portions 36 and 38 to form the generally "U-shaped" handle 32 and define a generally rectangular space 41 between the bottom of the sleeve 34 and horizontal portion 40 and vertical portions 36 and 38. Generally, vertical portions 36 and 40 will have a gentle inwardly slope from the sleeve 34 to the horizontal portion 40 as shown in FIG. 2. Preferably, the vertical portions 36 and 38 and horizontal portion 40 are integral.

The sleeve 34 includes recessed grooves 42 and 43 on both sides of sleeve 34 which generally run substantially the entire length of sleeve 34. The grooves 42 and 43 provide a region by which the gun operator can place his or her thumb for added grip of the forearm stock 28. It should be appreciated that use of groove 42 or 43 will depend on whether the gun operator is right or left handed.

The sleeve 34 also includes a plurality of longitudinally spaced ribs 44 running substantially perpendicular to the longitudinal axis of tubular sleeve 34 and grooves 42 and 43. The ribs 44 are located along a substantial distance of the length of forearm stock 28 and are positioned below groove 42 as shown. Each rib 44 generally runs from a point below one of the grooves 42 or 43, under the sleeve 34 to a point below the other groove. The ribs 44 provide further means for establishing more gripping integrity for the gun operator.

In operation, a gun operator will grasp the grip 12 with one hand and place his index finger of that hand on trigger 18. The gun operator will then grasp the forearm stock 28 with their other hand such that his or her palm and thumb rest against a side of the forearm stock 28 and his or her fingers will be within the space 41 formed between the forearm stock 28 and the horizontal portion 40 of the handle 32. A portion of the gun operator's palm may rest against the vertical portion 36 (see FIG. 2) of the handle 32 which is closest to the gun operator. After the gun operator fires a shot by pressing trigger 18, the gun operator pulls back on the forearm stock 28 sliding it along the magazine 26 towards them by the slide action linkage 24. The gun operator then pushes the forearm stock 28 away from him or her along the magazine 26 to its original location in a pumping style action. The pumping style action forces the discharged shell out of the ejection port 16, and forces a new shell from the magazine 26 into the chamber of the gun in a manner well known to those skilled in the art. The handle 32 provides the gun operator with a greater area by which the forearm stock 28 can be pumped, and a barrier for keeping the gun operator's hand on the forearm stock 28, thus reducing the chance the gun operator's hand will slip off of the forearm stock 28.

Referring to FIG. 2, the vertical portions 36 and 38 and horizontal portion 40 form the generally U-shaped configuration of the handle 32 according to a preferred embodiment of the present invention, and forms the space 41 for the gun operator's hand within the U-shaped enclosure of the handle 32 below the sleeve 34. The vertical portions 36 and 38 and the horizontal portion 40 can take a variety of shapes. In the embodiment shown in FIG. 2, the vertical portions 36 and 38 have a greater cross-sectional area at the ends near sleeve 34 than at the ends where they connect to horizontal portion 40. It should be appreciated that the horizontal portion 40 may be discontinuous such that the horizontal portion 40 extends longitudinally from each vertical portion 36 and 38 toward each other and terminate to leave an opening or space between the horizontal portion 40. Other shapes and cross-sectional areas of the vertical portions 36 and 38 and horizontal portion 40 can be readily visualized to encompass differing aesthetics and practicalities for different forearm stocks and pump action guns.

Referring to FIG. 3, the sleeve 34 includes a bore 48 extending the entire length of sleeve 34. When the forearm stock 28 is attached to the gun 10 as in FIG. 1, the magazine 26 is positioned within the bore 48. At the upper portion of the forearm stock 28 opposite the handle 32 is a recessed channel 46. When the forearm stock 28 is positioned on the gun 10 as shown in FIG. 1, the barrel 22 is positioned within the recessed channel 46. When the forearm stock 28 is pumped, it will ride along both the magazine 26 and the barrel 22. The ribs 44 generally take on a more squared configuration, thus enabling greater gripping integrity. As stated above, the ribs 44 generally begin at one of the grooves 42 or 43 and run under the sleeve 34 to a position below the other groove. It should be appreciated that the grooves 42 and 43 and ribs 44 are optional features which may be provided on the forearm stock 28.

Figure 4:
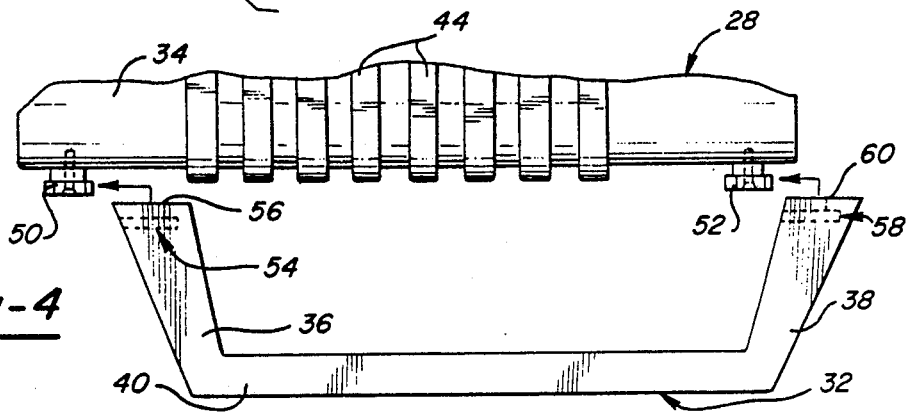
FIG. 4 is a partial exploded side view of a forearm stock and a removable handle according to the present invention.

Referring to FIG. 4, an alternative feature of forearm stock 28 is shown. The forearm stock 28 is provided with means for quickly and efficiently removing the handle 32. Located at a lower region of sleeve 34 are T-shaped tabs 50 and 52. Tab 50 will be configured to engage a T-shaped channel 54 located at surface 56 of the vertical portion 36, and tab 52 will be configured to engage a T-shaped channel 58 located at surface 60 of the vertical portion 38, both of the handle 32. Surfaces 56 and 60 have a shape such that they are formed to the contour of sleeve 34 at the tabs 50 and 52, respectively. It should be appreciated that the handle 32 may be removed during non-riot situations when the gun 10 is converted to other uses such as hunting, and the grip 12 is replaced by other types of gun stocks.

Figure 5:
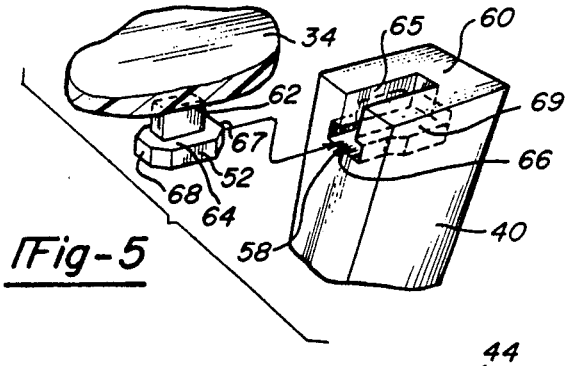
FIG. 5 is a cut-away perspective view of the removable handle of FIG. 4.

As illustrated in FIG. 5, the tab 52 and T-shaped channel 58 are shaped such that the handle 32 is locked in a desired position. The T-shaped tab 52 has a narrow upper portion 62 attached to sleeve 34 and a wider lower portion 64. To engage the handle 32 with the forearm stock 28, the upper portion 62 is aligned with the opening of region 65 of the channel 58 and the lower portion 64 is aligned with the opening of region 66 of the channel 58. This arrangement allows the tab 52 to be inserted and locked in the channel 58. A similar arrangement will be used for tab 50 and the channel 54.

The tab 52 has a shape such that it is tapered at both ends 67 and 68 of the lower portion 64. When the gun operator wishes to attach the handle 32 to forearm stock 28, the gun operator engages the end 67 of the lower portion 64 of the tab 52 with the region 66 of the channel 58. The wider part of lower portion 64 is slightly wider than the width of the region 66 of the T-shaped channel 58. The upper portion 62 fits within region 65 of the channel 58. The tapered end 67 will easily fit within the region 66, and as the handle 32 is slid further along on the tabs 50 and 52 the tapered end 67 will enable the tab 52 to be driven through region 66 to region 69. The region 69 is substantially the same shape and size as the tab 52, and thus the tab 52 will be locked there because of the size of region 66 and the tab 52. When the handle 32 is to be removed from the forearm stock 28, the tapered end 68 will enable the tab 52 to be forced out of the channel 58. The tab 50 and channel 54 operate in a similar manner.

The handle 32 is slid onto the tabs 50 and 52 as described above towards the gun operator, as shown in FIG. 4. In other words, the opening of channels 54 and 58 are towards or facing the gun operator. This is to ensure that the gun operator will not force the handle 32 off of tabs 50 and 52 during a normal pumping action of the gun. Generally, there will not be a force applied against the vertical portion 38 during a return motion of forearm stock 28. Therefore, the U-shaped handle 32 will not be forced off of the tabs 50 and 52 during normal operation of the pump action gun 10. It should be appreciated that any suitable means may be used to removably secure the handle 32 to the forearm stock 28.

Accordingly, the present invention provides an effective and reliable device for ensuring a gun operator's hand will not slip off of the forearm stock during the pumping action of the gun. Since the gun operator can rest part of his or her hand against the handle, the gun operator will be able to pump the gun more quickly, more smoothly and with more force thus reducing the chance of jamming the gun. The U-shaped handle enables the gun operator to utilize the natural horizontal plane below the forearm stock to even more effectively pump the gun. The U-shaped handle further provides protection of the gun operator's hand, and less of a chance the weapon can be forcibly taken from the gun operator. Therefore, the handle provides necessary and practical functions.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced otherwise than as specifically described.

What is claimed is:

1. A forearm stock for a pump action gun comprising:

an elongated, substantially tubular sleeve having a longitudinal axis and a first end and a second end spaced along said longitudinal axis; and a handle extending along said longitudinal axis and attached to said sleeve, said handle having a substantially vertical first portion having a length and attached proximate and first end of said sleeve, a substantially vertical second portion having a length and attached proximate said second end of said sleeve, and a substantially horizontal portion having a length greater than the length of said first and second portion, said horizontal portion attached to both said first and second portions, said first and second portions and said horizontal portion defining a space within the forearm stock.

2. The forearm stock of claim 1, wherein said sleeve includes means for removably detaching said handle from said sleeve.

3. The forearm stock of claim 1 wherein said handle is integral with said sleeve.

4. The forearm stock of claim 1 wherein said sleeve includes a plurality of spaced apart ribs, said ribs running substantially perpendicular to said longitudinal axis of said sleeve.

5. The forearm stock of claim 1 wherein said sleeve includes recessed channels on opposite sides of said sleeve, said channels running substantially the entire length of said sleeve.

6. A pump action shotgun comprising:

an end stock;

a breech attached to said end stock;

a barrel and a magazine attached to said breech opposite said end stock; and a forearm stock including a handle, said forearm stock including means to be slidable along said magazine when said shotgun is pumped, said forearm stock comprising a substantially tubular sleeve having a longitudinal axis and a first and second end spaced along said longitudinal axis, said handle having a substantially vertical first portion extending proximate said first end of said forearm stock opposite said barrel, a substantially vertical second portion extending proximate said second end of said forearm stock opposite said barrel, and a substantially horizontal portion having a length greater than a length of said first and second portions, said horizontal portion attached to both said first and second portions, said first and second portions and said horizontal portion defining a space within said forearm stock.

7. The shotgun of claim 6 wherein said sleeve includes means for releasably securing said handle to said forearm stock.

8. The shotgun of claim 6 wherein said forearm stock includes spaced apart rib sections.

9. The shotgun of claim 6 wherein said sleeve and said handle are integral.

10. A pump action shotgun comprising:

an end stock;

a breech attached to said end stock;

a barrel and a magazine attached to said breech opposite said end stock;

a forearm stock including a U-shaped handle, said forearm stock including means to be slidable along said magazine when said shotgun is pumped;

said handle including a first vertical portion extending from a first end of said forearm stock opposite said barrel, and a horizontal portion attached to said first and second vertical portions;

said forearm stock comprising an elongated, substantially tubular sleeve, said first and second vertical portions attached to said forearm stock at said sleeve;

said sleeve including means for releasably securing said handle to said forearm stock, wherein said means for releasably securing comprising at least one tab rigidly secured to said sleeve, said at least one tab engageable with a groove in at least one of said first or second vertical portions.

11. A handle for a forearm stock of a pump action gun comprising:

a handle including a substantially vertical first portion extending from a first end of the forearm stock, a substantially vertical second portion extending from a second end of the forearm stock, and a substantially horizontal portion having a length greater than a length of said first and second portions, said horizontal portion attached to said first and second portions, said first and second portions and said horizontal portion are adapted to define a space below the forearm stock.

* * * * *